United States Patent [19]

Scherbing

[11] Patent Number: 4,621,510

[45] Date of Patent: Nov. 11, 1986

[54] AXIAL PIN TUBULAR LOCK WITH IMPROVED PUNCH-OUT SECURITY

[75] Inventor: Frank J. Scherbing, Chicago, Ill.

[73] Assignee: Fort Lock Corporation, River Grove, Ill.

[21] Appl. No.: 639,593

[22] Filed: Aug. 10, 1984

[51] Int. Cl.[4] ..... E05B 27/08

[52] U.S. Cl. ..... 70/363

[58] Field of Search ..... 70/363, 362, 375, 373, 70/372

[56] References Cited

U.S. PATENT DOCUMENTS 3,961,507 6/1976 Falk ..... 70/363

4,100,777 7/1978 Fredon ..... 70/363

*Primary Examiner*—Robert L. Wolfe

*Attorney, Agent, or Firm*—Leydig,Voit & Mayer,Ltd.

[57] ABSTRACT

A retaining pin extends inwardly through the outer barrel and the tumbler sleeve of a resettable, axial pin tubular lock and projects into a circumferential groove formed around the locking spindle. A rearwardly facing shoulder defined by the forward wall of the groove engages the inner end portion of the retaining pin and prevents the spindle from being forcibly punched rearwardly within the tumbler sleeve. The retainer pin also holds the tumbler sleeve in a fixed position in the outer barrel.

6 Claims, 6 Drawing Figures

AXIAL PIN TUBULAR LOCK WITH IMPROVED PUNCH-OUT SECURITY

BACKGROUND OF THE INVENTION

This invention relates to an axial pin tubular lock of the type in which a locking spindle is rotatably mounted in a tumbler sleeve and normally is held against rotation by pins extending axially between the tumbler sleeve and a driver ring. The tumbler sleeve is held in a rigidly fixed position in an outer barrel which serves to mount the lock in a cabinet door or the like.

The lock of the invention preferably is a resettable lock of the same general type as disclosed in Falk U.S. Pat. No. 3,961,507, although the principles of the invention are not limited to a resettable lock. In the present resettable lock, the driver ring is in the form of a sleeve which is keyed to rotate with the spindle and which is located adjacent a reset sleeve supported for selective rotation on the spindle. By using a reset key to rotate the reset sleeve relative to the driver sleeve, the code of the lock may be changed so as to require the use of a different service key to open the lock.

In certain prior tubular locks, it has been relatively easy to destroy the lock by hammering on the locking spindle with a punch from the front of the lock and knocking the spindle rearwardly. In some locks, rearward knock-out of the spindle is prevented only by virtue of a slightly enlarged shoulder on the forward end portion of the spindle engaging the forward face of the reset sleeve or driver sleeve around the inner periphery thereof. When the spindle is punched rearwardly, the shoulder shears away the inner peripheral portion of the reset sleeve and/or driver sleeve to free the spindle to first slide rearwardly and then to turn to an unlocked position.

SUMMARY OF THE INVENTION

The general aim of the present invention is to provide a new and improved tubular lock in which the security against forcible knock-out of the spindle is greatly increased in a very simple and inexpensive manner.

Another object of the invention is to provide a retainer which coacts with a novel shear-resistant shoulder on the spindle to prevent the spindle from being forcibly knocked rearwardly. The shoulder preferably is defined by the rearwardly facing wall of an easy-to-form groove extending circumferentially around the spindle.

Still a further object of the invention is to use the same retainer which prevents knock-out of the spindle for also holding the tumbler sleeve in a rigidly fixed position in the barrel of the lock.

These and other objects and advantages of the invention will become more apparent from the following detailed description when taken in conjunction with the accompanying drawings.

DETAILED DESCRIPTION OF THE PREFERRED EMBODIMENT

Figure 1:
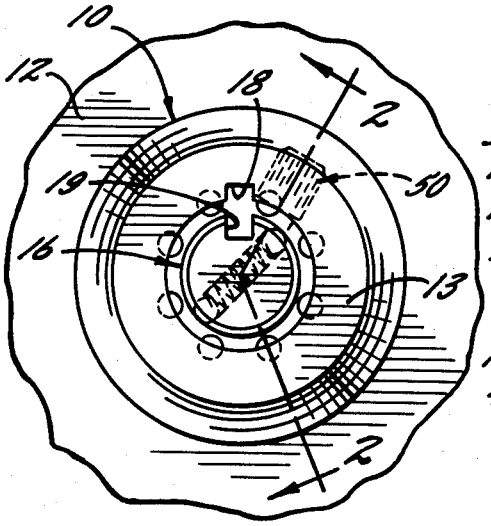
FIG. 1 is a front elevational view of a new and improved tubular lock incorporating the unique features of the present invention.

As shown in the drawings for purposes of illustration, the invention is embodied in an axial pin tubular lock 10 of the type widely used in vending machines and the like. The lock which has been shown includes an outer tubular barrel 11 (FIG. 2) adapted to be threaded into a cabinet member 12 and having a frustoconical head 13 spaced from the front of the cabinet member by a washer 14. A stationary tumbler sleeve 15 is telescoped into and is anchored rigidly within the rear end portion of the barrel and rotatably supports an elongated spindle 16 which extends through the barrel. When the spindle is turned, a locking plate 17 fastened to the rear end portion of the spindle is moved between locked and unlocked positions. Turning of the spindle may be effected by a service key (not shown) adapted to be telescoped into the head and over the spindle and having tabs adapted to aline with keyways 18 and 19 (FIGS. 1 and 6) in the head and the spindle, respectively.

Figure 5:
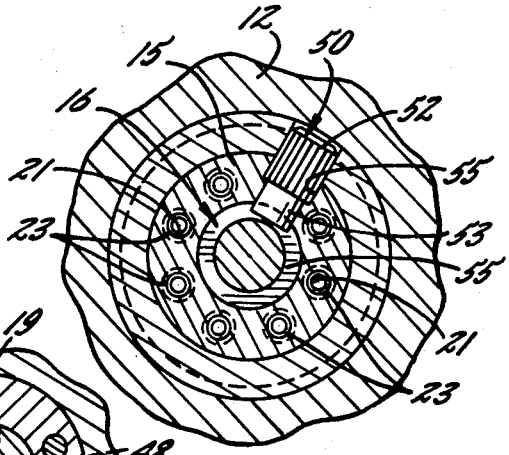
FIG. 5 is a fragmentary cross-section taken substantially along the line 5—5 of FIG. 2.

The spindle 16 normally is held in its locked position by a series of seven angularly spaced tumbler pins 20 (FIGS. 5 and 6) telescoped slidably in bores 21 (FIG. 2) in the tumbler sleeve 15 and urged forwardly by coiled compression springs 23 disposed in the bores an acting against threaded plugs 24 in the rear ends of the bores. Herein, the seven pins are spaced equally from one another by angles of 45 degrees except that the spacing between the two uppermost pins is 90 degrees (see FIG. 6).

Figure 4:
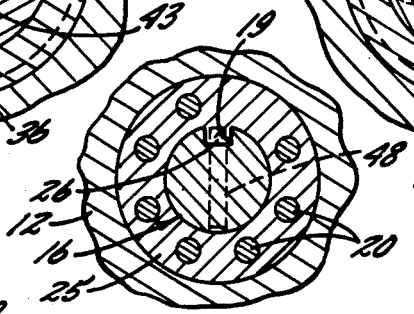
FIG. 4 is a partial cross-section taken substantially along the line 4—4 of FIG. 2.

A driver ring 25 (FIGS. 2 and 6) is located in face-to-face relation with the forward end of the tumbler sleeve 15 and rotates with the spindle 16. In this particular instance, the driver ring is in the form of a washer or axially thin sleeve stamped from sheet metal. Formed integrally with and projecting inwardly from the inner periphery of the driver sleeve 25 is a short key 26 (FIG. 4) which fits into and mates with the keyway 19 in order to anchor the driver sleeve for rotation with the spindle.

Figure 2:
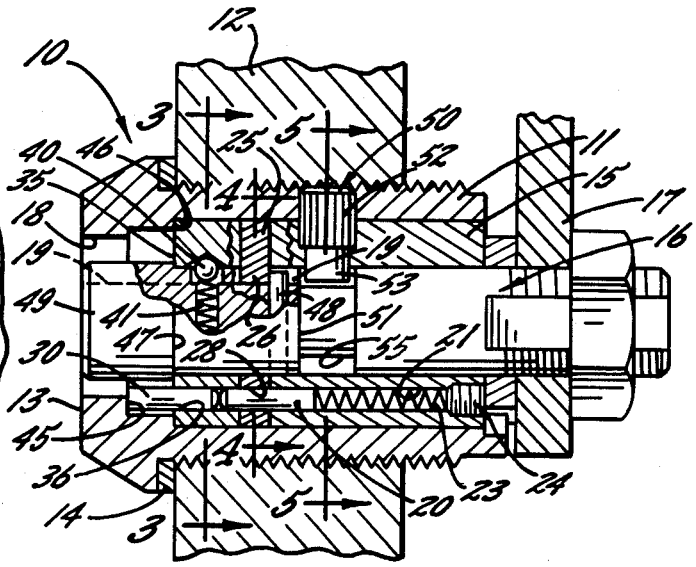
FIG. 2 is a fragmentary cross-section taken substantially along the line 2—2 of FIG. 1.
Figure 6:
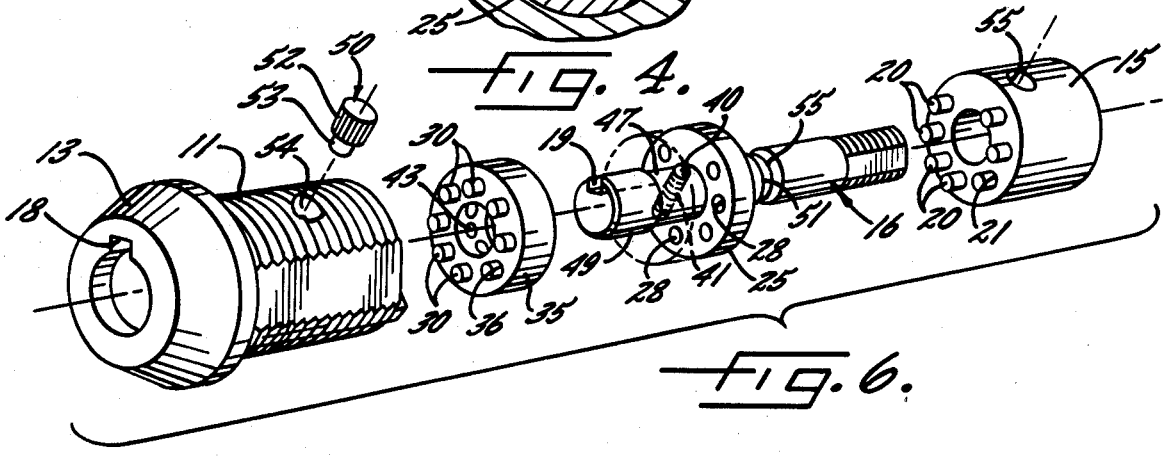
FIG. 6 is an exploded perspective view of certain parts of the lock.

As shown in FIGS. 2 and 6, the tumbler pins 20 normally extend forwardly into seven holes 28 formed through the driver sleeve 25, the pins thus locking the driver sleeve 25 and the spindle 16 against rotation relative to the tumbler sleeve 15. Such rotation is permitted when the tumbler pins are shifted rearwardly such that the forward ends of all of the pins lie in a shear plane at the interface of the driver sleeve 25 and the tumbler sleeve 15. Rearward shifting of the driver pins is effected by a proper service key acting to shift seven of eight driver pins 30 (FIGS. 2, 3 and 6) rearwardly through the holes 28 in the driver sleeve and against the forward ends of the tumbler pins 20. The different driver pins are of different lengths and thus only a properly coded key is effective to cause the rear ends of all of the driver pins and the forward ends of all of the tumbler pins to simultaneously occupy the shear plane at the interface of the sleeves 15 and 25.

The specific lock 10 which has been illustrated is a resettable lock of the same general type as disclosed in Falk U.S. Pat. No. 3,961,507 in which reference is made for a detailed disclosure of the specific construction and operation of the reset feature. Briefly, a reset sleeve 35 (FIGS. 2, 3 and 6) is located on the spindle 16 in face-to-face relation with the forward end of the driver sleeve 25 and is formed with eight equally spaced holes 36. The holes 36 normally receive the forward end portions of the tumbler pins 20 and the rear end portions of the driver pins 30 (see FIG. 2).

Figure 3:
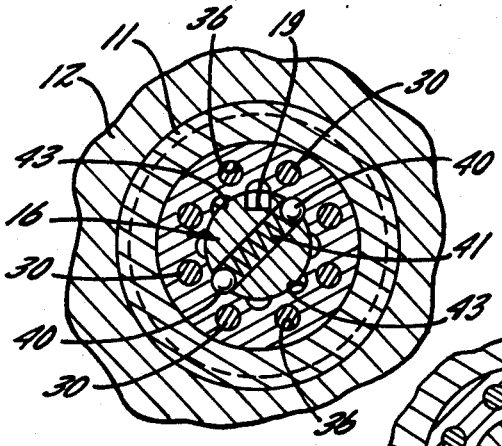
FIG. 3 is a fragmentary cross-section taken substantially along the line 3—3 of FIG. 2.

As shown in FIGS. 2 and 3, the reset sleeve 35 is rotatable on the spindle 16 and is adapted to be held releasably in eight angularly spaced detent positions by a pair of balls 40 pressed outwardly by a spring 41 disposed in a radial hole 42 in the spindle. The balls are sized to seat releasably in eight angularly spaced notches 43 (FIG. 3) formed in the inner periphery of the reset sleeve 35.

When an appropriate reset key is inserted into the lock 10, the driver pins 30 are shifted rearwardly through a sufficient distance to locate the rear ends of all of the driver pins at the interface of the reset sleeve 35 and the driver sleeve 25. Thereafter the reset sleeve may be rotated on the spindle 16 from one detent position to any other detent position in order to bring different driver pins 30 into angular alinement with different tumbler pins 20 and thereby require the use of a differently coded service key to open the lock. In this way, the reset key may be used to reset the lock for several different service keys; the resetting operation and the advantages thereof being explained more fully in the above-identified Falk patent. In the present lock, however, one of the eight driver pins 30 is always inactive since the lock only includes seven tumbler pins 20.

To retain the various elements within the barrel 11, an annular shoulder 45 (FIG. 2) is formed in the inner side of the head 13 and engages the forward ends of the driver pins 30 to captivate the pins in the holes 36 in the reset sleeve 35. A second annular shoulder 46 is formed in the forward end portion of the barrel 11 and engages the forward end of the reset sleeve 35 to prevent the reset sleeve from sliding forwardly within the barrel. In addition, the reset sleeve 35 and the driver sleeve 25 are captivated axially on the spindle 16 by a slightly enlarged rearwardly facing shoulder 47 located at the forward end portion of the spindle and by a roll pin 48 at the rear end of the driver sleeve. The roll pin is pressed into a radial hole in the spindle and has an outer end portion which projects into the keyway 19 and engages the rear face of the key 26 on the driver sleeve 25 to prevent the latter from sliding rearwardly on the spindle. The roll pin also holds the forward end of the reset sleeve 35 against the shoulder 47. The shoulder is formed by making the forward end portion 49 of the spindle slightly larger in diameter than that portion of the spindle extending rearwardly from the forward end of the reset sleeve 35.

Engagement of the shoulder 47 with the forward end of the reset sleeve 35 prevents the spindle 16 from sliding rearwardly. In order to enable the service key to be telescoped into the head 13, the outer end portion 49 of the spindle has a limited maximum diameter and thus the retaining shoulder 47 is very narrow in radial width, the outer diameter of the shoulder being only about 0.050″ greater than the inner diameter of the sleeves 35 and 25. As a result, if a hammer and punch are used to forcibly knock the spindle rearwardly, the shoulder 47 can rather easily shear away the inner peripheral portions of the sleeves 35 and 25 and move rearwardly through those sleeves. Once the shoulder has sheared away the axially thin sheet metal key 26 on the driver sleeve 25, the spindle 16 no longer is held against rotation and thus the locking plate 17 may be turned to its unlocked position.

In accordance with the present invention, the security of the lock 10 against forcible rearward knock-out of the spindle 16 is greatly improved through the use of a retainer 50 (FIGS. 2, 5 and 6) which engages a relatively large radial shoulder 51 on the spindle. It is virtually impossible to shear away or otherwise destroy either the retainer 50 or the shoulder 51 with a manual punching force and thus the danger of the spindle being forcibly knocked rearwardly is practically eliminated.

More specifically, the retainer 50 which is used herein is very similar to the retainer which has been used in prior locks to hold the tumbler sleeve 15 in an axially and circumferentially fixed position in the barrel 11. Thus, the retainer is in the form of a pin having an enlarged head 52 and a reduced-diameter shank 53, the outer surface of the head being formed with a straight knurl. The outer end portion of the head is received with a press fit in a hole 54 (FIG. 6) extending radially through the barrel 11 while the shank and the inner end portion of the head are received in a counterbored hole 55 in the tumbler sleeve 15.

In carrying out the invention, the inner end portion of the shank 53 of the pin 50 extends radially beyond the inner diameter of the tumbler sleeve 15 and is positioned to engage the shoulder 51 (see FIG. 2). Herein, the shoulder 51 is formed by reducing the diameter of the spindle 16 and specifically by forming a relatively deep circumferential groove 55 around the spindle at a position located rearwardly of the driver sleeve 25. The inner end portion of the shank 53 extends into the groove 55 and is located to engage the shoulder 51 defined by the rearwardly facing forward wall of the groove. The extreme inner end of the shank stops short of the bottom of the groove and thus the shank does not interfere with normal rotation of the spindle 16. Also, it will be noted in FIGS. 2 and 5 that the retainer pin 50 extends through the tumbler sleeve 15 at the circumferential position where the two tumbler pins 20 are spaced 90 degrees from one another. Accordingly, the shank of the pin may be relatively large in diameter.

If an attempt is made to punch the spindle 16 rearwardly, the rearwardly facing shoulder 51 defined by the forward wall of the groove 55 engages the shank 53 of the retainer pin 50 and stops rearward movement of the spindle before the narrow shoulder 47 can move into the driver sleeve 25 and shear away the key 26. Accordingly, the spindle remains rotatably coupled to the driver sleeve to preserve the integrity of the lock 10. Because the shoulder 51 has a significantly greater radial width than the shoulder 47, it is virtually impossible to shear away the shoulder 51. Also, the relatively large diameter of the shank 53 of the pin 52 prevents the pin from being sheared by a manual punching force.

I claim:

1. A tubular lock comprising an outer barrel having forward and rear ends, a stationary tumbler sleeve telescoped into the rear end portion of said barrel, a locking spindle extending through and rotatably mounted in said tumbler sleeve, a driver ring rotatable with said spindle and disposed within said barrel in face-to-face relation with the forward end of said tumbler sleeve, and axially extending and angularly spaced pins slidably mounted in holes in said tumbler sleeve and said driver ring and normally operable to prevent rotation of said spindle within said tumbler sleeve, said lock being characterized in that said spindle is formed with a reduced diameter portion positioned between the ends of said tumbler sleeve and defining a rearwardly facing shoulder, and a radially extending retainer having an outer end portion disposed in said barrel and tumbler sleeve and having an inner end portion disposed rearwardly of said shoulder, the inner end portion of said retainer leaving said spindle free for rotation but being engageable with said shoulder to prevent said spindle from being forcibly pushed rearwardly within said tumbler sleeve.

2. A tubular lock as defined in claim 1 in which said reduced diameter portion of said spindle is defined by a groove formed circumferentially around the spindle between the ends thereof, said shoulder being defined by the forward wall of said groove.

3. A tubular lock comprising a tubular barrel having forward and rear ends, a stationary tumbler sleeve telescoped into the rear end portion of said barrel, a locking spindle extending through and rotatably mounted in said tumbler sleeve, a driver sleeve fastened to and rotatable with said spindle and disposed within said barrel in face-to-face relation with the forward end of said tumbler sleeve, and axially extending and angularly spaced pins slidably mounted in holes in said tumbler sleeve and said driver sleeve and normally operable to prevent rotation of said spindle within said tumbler sleeve, the improvement in said lock comprising, a circumferentially extending groove formed in said spindle rearwardly of the forward end of said tumbler sleeve and having a forward wall defining a rearwardly facing shoulder, and a retainer extending radially within said barrel and said tumbler sleeve and having an inner end portion disposed in said groove, the inner end portion of said retainer leaving said spindle free for rotation but engaging said rearwardly facing shoulder to prevent said spindle from being forcibly pushed rearwardly within said tumbler sleeve.

4. A tubular lock as defined in claim 3 in which said retainer comprises a pin having an outer head pressed into said barrel with an interference fit, the inner end portion of said pin being defined by a reduced diameter shank disposed in said groove with the inner end of the shank spaced radially outwardly from said spindle.

5. A tubular lock as defined in claim 4 in which said pins are spaced from one another around said tumbler sleeve by equal distances except for two pins which are spaced from one another by a greater distance, said retainer pin extending through said tumbler sleeve in the space between said two pins.

6. A resettable axial pin tubular lock comprising an outer barrel having forward and rear ends, a stationary tumbler sleeve telescoped into the rear end portion of said barrel, a locking spindle extending through and rotatably mounted in said tumbler sleeve and formed with an axially extending keyway, a driver sleeve telescoped over said spindle and formed with an integral, radially extending key projecting into said keyway to couple said driver sleeve for rotation with said spindle, the rear face of said driver sleeve being disposed in face-to-face relation with the forward face of said tumbler sleeve to prevent said driver sleeve from shifting rearwardly within said body, a reset sleeve rotatable to different positions on said spindle and having a rear face disposed in face-to-face relation with the forward face of said driver sleeve, a first rearwardly facing shoulder on the outer end portion of said spindle and engageable with the forward face of said reset sleeve to prevent said spindle from sliding rearwardly in said reset sleeve and said driver sleeve, and angularly spaced pins slidably mounted in holes in the three sleeves and normally operable to prevent rotation of said spindle within said tumbler sleeve, the improvement in said lock comprising, a circumferentially extending groove formed in said spindle rearwardly of the forward end of said tumbler sleeve and having a forward wall defining a second rearwardly facing shoulder, and a retainer extending radially within said barrel and said tumbler sleeve and having an inner end portion disposed in said groove, the inner end portion of said retainer leaving said spindle free for rotation but engaging said second rearwardly facing shoulder to prevent said spindle from being forcibly pushed rearwardly sufficiently far to enable said first shoulder to shear away said key and decouple said spindle from said driver sleeve.

* * * * *